United States Patent [19]

Suied

[11] Patent Number: 4,503,919

[45] Date of Patent: Mar. 12, 1985

[54] BORING DEVICES

[76] Inventor: Joseph P. Suied, 191 rue d'Alésia, 75 014 Paris, France

[21] Appl. No.: 465,780

[22] Filed: Feb. 11, 1983

[30] Foreign Application Priority Data

Feb. 11, 1982 [FR] France ..... 82 02224

[51] Int. Cl.[3] ..... E21B 10/32

[52] U.S. Cl. ..... 175/269

[58] Field of Search ..... 175/65, 267, 269

[56] References Cited

U.S. PATENT DOCUMENTS

| | | | |
|---|---|---|---|
| 2,334,788 | 11/1943 | O'Leary | 175/267 |
| 2,627,925 | 2/1953 | Scivally | 175/267 X |
| 3,415,331 | 12/1968 | Van Gils | 175/65 |
| 3,556,233 | 1/1971 | Gilreath | 175/267 |
| 3,690,166 | 9/1972 | Grice | 175/65 |

FOREIGN PATENT DOCUMENTS

| | | | |
|---|---|---|---|
| 221603 | 7/1968 | U.S.S.R. | 175/267 |
| 761694 | 9/1980 | U.S.S.R. | 175/267 |

*Primary Examiner*—William F. Pate, III

*Attorney, Agent, or Firm*—Larson and Taylor

[57] ABSTRACT

The improvement in the boring devices is adapted to cut grooves or cavities at the bottom of bored holes. It comprises a tool (3) containing a diaphragm (17) forming an expansion chamber to which a liquid under pressure can be supplied for radially displacing cutting elements (24) set with diamonds between a retracted position and a projecting working position. The measurement of the variation of the volume of the liquid under pressure in a chamber (26) enables the radial position of the elements (24) to be known.

10 Claims, 3 Drawing Figures

BORING DEVICES

The present invention relates to an improvement in boring devices and is in particular applicable to boring in the ground, rock or concrete.

Known boring devices, whether they employ a bit, drill or trepan, bore holes having a constant section and consequently a cylindrical inner wall. Now, it is often desirable to increase the diameter of the hole at one or more places remote from the entrance and in particular at the bottom of the hole. Such an increase in diameter, producing a local excavation, is for example of use when it is desired to increase the receiving surface of a well bottom or when it is desired, in the case of holes for receiving piles, ties, pins, etc., merely to improve the anchoring of the element in the holes.

Tools are known for increasing the diameter of a well bottom, which tools have a cylindrical shape with elements pivotable between a retracted position in which they do not project from the cylindrical wall and the tool and a projecting position in which they project from this wall and, owing to the rotation of the tool, cut a circular groove in the wall of the hole. The pivoting of these elements between the retracted position and the projecting position is ensured by a central plunger which is mechanically connected to said elements and whose axial position determines the angle of the pivoting of the elements.

Such a device is however rather complex and does not lend itself to miniaturization. Further, the mechanical connection between the elements and the plunger may be subject to jamming or a bad distribution of the forces. Furthermore, the pivotal element does not operate under the same conditions as it pivots and this affects both the characteristics of the work and the geometry of the cavity obtained.

Tools have also been proposed which are provided with cutting elements expansible between a retracted position and a projecting position relative to the generally cylindrical surface of the tool, owing to a pneumatic actuation. Such an arrangement however also has drawbacks. In particular, it does not permit a suitable control of the work which, it must be remembered, is carried out out of the sight of the operator.

An object of the present invention is to overcome these drawbacks and to provide an improvement in boring devices of the type comprising a tool having a substantially cylindrical shape capable of being easily introduced in and and extracted from a hole which is preferably previously bored, and containing cutting elements movable between a retracted position within the cylindrical surface of the tool and a projecting position in which the rotation of the tool results in the cutting of a groove by said elements, driving means being provided for shifting said elements from the retracted position to the projecting position and vice versa, wherein said tool comprises a radially expansible fluid-tight coaxial diaphragm, cutting elements, such as sectors set with diamonds, disposed on the diaphragm, and preferably rigid therewith, a conduit connecting the interior of the diaphragm to a source of liquid under pressure, and means for putting said liquid under pressure.

Preferably, the cutting elements, for example constructed in the form of bars or sectors set with diamonds, are evenly angularly spaced apart around the diaphragm and said elements are advantageously mounted on metal sectors whose inner wall is in contact with the outer wall of the diaphragm so that the expansion of the diaphragm radially displaces said sectors, and consequently the cutting elements carried thereby, while the retraction of the diaphragm retracts then to their retracted position.

Preferably, the body of the tool provides radial guiding means for the cutting elements and/or for said sectors which carry these elements. These guiding means may comprise simple grooves in the cylindrical wall of the tool.

However, it must be understood that it is not absolutely essential to provide guiding means in this form and the cylindrical wall of the tool may be locally missing in the region of said cutting elements.

Particularly advantageously, the diaphragm, for example made from an elastomer such as Neoprene, may be in the form of a cylindrical sleeve whose two ends are suitably set or gripped between the body of the tool and setting members, one of said setting members being provided with a passage for the passage of the liquid between the liquid supply pipe and the interior of the diaphragm which constitutes an expansion chamber.

According to an advantageous feature of the invention, the device comprises a liquid chamber remote from the tool, in which chamber it is possible to measure visually, or in any other way, the variation in the volume of the liquid in the chamber which corresponds to the variation in the volume of the diaphragm and consequently the distance of the radial displacement of the cutting elements. Thus it is possible to know at any time what is the exact geometric conformation of the tool and consequently the diameter of the groove being cut. The device may also comprise a pressure gauge or pressure indicator for checking that there is no leakage, which makes it quite sure that the observed variation in the volume of the liquid does in fact correspond to a radial displacement of the cutting elements.

The means for creating the pressure may advantageously comprise a compressor which may be preferably reversible so as to create, at the end of the actuation, a depression which retracts the diaphragm and consequently retracts the cutting elements.

However, this retraction may, by way of a modification, be ensured by elastically yieldable means which may be possibly constituted by the elasticity of the diaphragm or by auxiliary means for returning the diaphragm and the cutting elements to their initial retracted position when the pressure has sufficiently dropped in the chamber defined by the diaphragm.

Further features and advantages of the invention will be apparent from the ensuing description, which is given merely by way of example with reference to the accompanying drawings in which.

Figure 1:
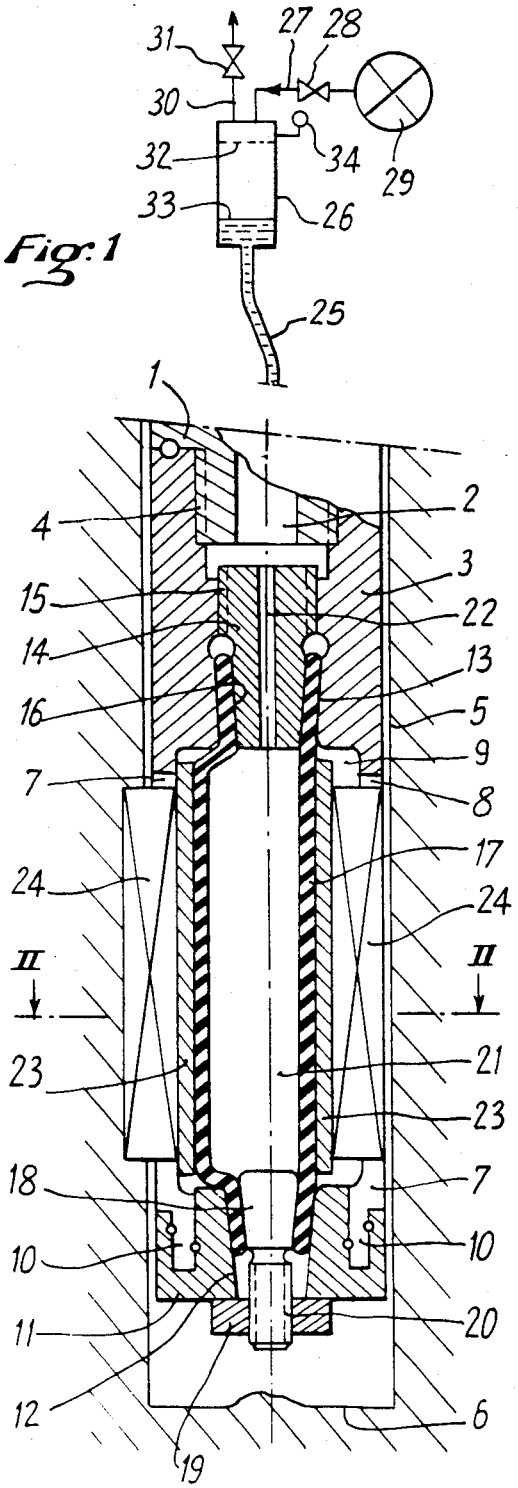
FIG. 1 is a diagrammatic sectional view, taken on line I—I of FIG. 2, of a boring device according to the invention.

The device according to the invention, as described in the example, comprises at the end of an elongated cylindrical rod 1, provided with a central passage 2 throughout its length, a tool 3 screwed on the end of the rod 1 by a screwthread 4. The rod 1 is continued upwardly to a second end by which it is mounted on driving means for driving it in rotation about its axis, inside a previously-bored cylindrical hole of slightly larger diameter, the cylindrical wall 5 and the bottom 6 of which are shown.

The tool 3 itself has an outer cylindrical surface having the same diameter as the rod 1, the part of the tool 3 screwed on the rod 1 being extended downwardly by three arms 7 which define elongated slots 8 disposed around an inner chamber 9. The three lower ends of the arms 7 have an offset part 10 which is received in a corresponding groove of an end member 11 in which it is retained by suitable rings. The member 11 has a tapered central passage 12 and the tool 3 also has a cavity which includes, adjacent to the chamber 9, a downwardly tapered bearing surface 13.

Screwed inside this passage by means of a suitable screwthread 15 is a setting end member 14 which is extended by a tapered bearing surface 16 corresponding to the surface 13. It is in this way possible, when screwing the end member 14, to set or grip a cylindrical sleeve of elastomer whose other end is placed around a tapered setting plug 18 which, when it is inserted in the tapered passage 12 and shifted downwardly in this passage by a nut 19 cooperating with its screwthread 20, sets in a fluidtight manner the lower end of the diaphragm constituted by the sleeve 17 of elastomer. The interior 21 of the sleeve 17 defines a volume constituting an expansion chamber which communicates with the passage 2 of the rod 1 by way of a conduit 22 formed in the end member 14.

Around the sleeve 17 are bonded or vulcanized three elongated metal segments 23 on which are fixed and adhered cutting elements constituted here each time by a longitudinal bar forming a sector 24 set with diamonds.

In the upper part which extends out of the entrance of the bored hole in which the rod is disposed, the end of the rod is connected, preferably by a rotating coupling, to a conduit 25 of constant volume communicating with the passage 2. The conduit 25 leads to a vertical cylindrical chamber 26 to the upper end of which is connected a pipe 27 which is connected, through a valve 28, to a source of air pressure 29, such as a compressor or a compressed air tank. A second pipe 30 is connected to a valve 31 and constitutes a vent.

The device operates in the following manner: in the absence of an over-pressure of air in the chamber 26, the position of the elastomer diaphragm 71 is that shown in the right part of FIG. 1 and in FIG. 2. This position is termed the retracted position, and it can be seen that, in this position, the cutting elements 24, connected to the diaphragm 17 by the segments 23, occupy a retracted position in which they do not project beyond the overall size of the outer cylindrical surface of the tool 3, i.e. beyond the outer surface of the extensions 7. The tool, disposed at the end of the rod 1, can consequently be introduced in a hole whose diameter is very slightly larger than that of the tool and rod.

It must be understood that the characteristics of the elastic diaphragm 17 are such that, even when the tool is brought to a vertical position at the lower end of the rod 1, the hydrostatic pressure of the liquid contained in the chamber 26, the pipe 25, the passage 2, the conduit 22 and the chamber 21, is incapable of substantially deforming the diaphragm 17.

Under these conditions, the level of the liquid is represented by the dotted line 32 so that the major part of the chamber 26 is then filled with liquid.

With the valve 31 closed, the valve 28 is then opened and the raising of the air pressure in the chamber 26 above the surface of the liquid is commenced. This then urges the liquid toward the chamber 21 and the diaphragm 17 is then deformed and radially outwardly expands, radially outwardly displacing the segments 23 and the elements 24 which are radially guided by the edges of the extensions 7 which define the slots 8. If the rod 1 and the tool 3 are at the same time caused to rotate about their common axis, it will be understood that the cutting elements 24, which rotate by rubbing against the wall 5, will gradually cut into the latter a groove whose section corresponds to the part of the elements 24 which penetrates the material. Meanwhile, the liquid level drops in the chamber 26.

At a certain instant, under the effect of the thrust of the liquid and the cutting of the groove, the segments 23 abut against the extensions of the tool 3 so that any further radial expansion is prevented. This corresponds to the position shown on the left side of FIG. 1 in which the cutting elements 24 are in their extreme projecting position. The chamber 21 has then assumed its maximum volume and the liquid level in the chamber 26 has reached its lower position indicated at 33.

It is clear that, if the position of the level of the liquid in the chamber 26 is shown, for example by means of a graduation, or by any other means such as a float connected to an indicator system, the extent to which the elements 24 have radially moved out of the slots 8 can be determined at each instant during the cutting of the groove in the wall 5.

Preferably, the air pressure within the chamber 26 is constantly indicated by a pressure gauge 34. So long as the gauge 34 shows a sufficient pressure, one is certain that there is no leakage and that the drop in the level of the liquid in the chamber 26 does in fact correspond to an increase in the volume of the chamber 21 formed by the diaphragm 17.

Figure 2:
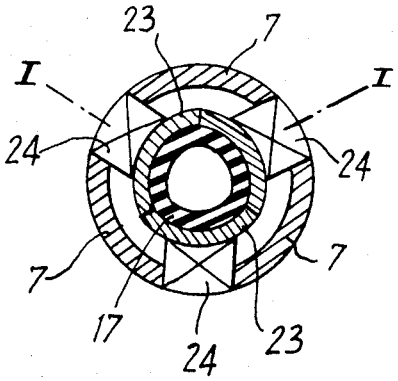
FIG. 2 is a diagrammatic sectional view, taken on line II—II of FIG. 1, of the tool in the retracted position.
Figure 3:
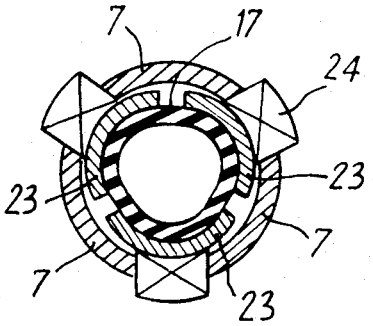
FIG. 3 is a view of the elements of FIG. 2 in the expanded state.

When it is desired to return the cutting elements 24 to their retracted position corresponding to FIG. 2 at the end of the cutting of the groove, so as to permit the extraction of the tool from the hole, the valve 28 is closed and the valve 31 is opened, which releases the air and thus the elastic return force exerted by the diaphragm 17 expels the excess of liquid from the chamber 21 toward the chamber 26 in which the liquid level is returned to its initial position 32. The rod and the tool can now be axially extracted upwardly out of the hole.

By way of a modification, if the elastic return force exerexerted by the diaphragm 17 is insufficient, the return to the retracted position can be produced for example by a suitably disposed spring which tends to oppose the radial separation of the segments 23.

In another modification, a depression can be created in the chamber 26 so as to return the diaphragm 17 to its retracted position.

Various modifications may of course be made in the invention. Thus, instead of providing cutting elements 24 in the form of rectilinear bars extending almost throughout the length of the diaphragm 17, these elements may be replaced by a plurality of elements of shorter length and axially spaced apart. Further, the section and the profile of the cutting elements 24 may vary as desired.

Further, it will be understood that the device according to the invention, which permits the boring of a groove at the bottom of a hole, may also be arranged to permit the boring of the hole itself. It is sufficient to provide at the lower end of the tool 3 a suitable boring tool so that the hole is first bored after which, preferably by stopping the descent of the tool, the groove is cut by the expansion of the elements 24 from the retracted position to the projecting position thereof.

Moreover, the cutting elements 24 may not be set with diamonds, in particular when they are to work in a soft rock (for example chalk). They may be formed by or coated with any suitable abrasive material.

In another modification, the diaphragm or sleeve 17 may be disposed around a rigid tube; the conduit 22 is then put in communication with a chamber 21 of annular shape defined between the diaphragm 17 and this tube.

In yet another modification, the conduit 22 comprises two branches, namely one for supplying the liquid for inflating the diaphragm 17 (as described hereinbefore) and the other for supplying to the region of the slots 8 a liquid for cooling the cutting elements 24. In the case of the preceding modification in which the diaphragm 17 is disposed around a rigid tube, the second branch of the conduit 22 opens out at the bottom of this tube so that the cooling liquid can rise along the cutting tools 24.

It will be understood that the system for supplying fluid under pressure has been shown only diagrammatically at the top of FIG. 1. Thus there may be provided a stop valve at the bottom of the vertical cylindrical chamber 26, i.e. at the beginning of the pipe 27, in order to avoid the phenomena of expansion by hydrostatic pressure mentioned hereinbefore. Further, a pressure reducing valve or a pressure limiting valve should be provided for the air acting on the water so that it is possible to select the ideal cutting pressure exerted on the cutting elements 25 in accordance with the nature of these elements 24 and the nature of the material in which the groove must be formed. In any case, said supply system is so arranged as to cause liquid to descend to the tool 1 first of all with increase in pressure until the elements come into contact with the wall 5, then with the maintenance of the optimum cutting pressure until the end of the operation, and then to allow said liquid to rise until the cutting elements 24 are disengaged from the material of the hole.

Having now described my invention what I claim as new and desire to secure by Letters Patent is:

1. A boring device comprising a tool structure having a substantially cylindrical stage, capable of being easily introduced in and extracted from a hole and including cutting elements capable of being displaced between a retracted position within the cylindrical surface of the tool structure and a projecting position in which projecting position rotation of the tool structure cuts a groove by means of the cutting elements, driving means for shifting the cutting elements from the retracted position to the projecting position and vice versa, said driving means comprising a radially expansible fluidtight diaphragm which is coaxial with the tool structure and which defines a closed expansion chamber, the cutting elements being disposed on the diaphragm, a source of liquid under pressure, means for putting said liquid under pressure, and conduit means for putting the closed expansion chamber defined by the diaphragm in communication with said source of liquid, said conduit means terminating at the closed expansion chamber formed by said fluidtight diaphragm so that liquid from said source is prevented from flowing into the hole in which the boring device is introduced.

2. A device according to claim 1, wherein the cutting elements are rigid with the diaphragm.

3. A device according to claim 2, comprising metal sectors having an inner wall in contact with an outer wall of the diaphragm, the cutting elements being mounted on the sectors.

4. A device according to claim 1, wherein the tool structure has a body which defines radial guiding means for the displacement of the cutting elements.

5. A device according to claim 1, wherein the diaphragm comprises a cylindrical sleeve having opposite end portions, two members respectively cooperative with said body for maintaining the respective end portions of the sleeve in position between the members and the body, one of said members being provided with a conduit for the passage of the liquid between said source of liquid under pressure and the interior of the diaphragm.

6. A device according to claim 5, wherein said members have tapered surfaces which cooperate with corresponding tapered surfaces of the body for gripping said end portions of the sleeve.

7. A device according to claim 1, wherein the tool structure has a body with longitudinally extending extensions defining slots, the diaphragm being disposed within said extensions and the cutting elements being displaceable through said slots between said retracted position and said projecting position.

8. A device according to claim 7, wherein the extensions have a free end portion and an end member constituting an end of the tool structure is fixed on the free end portion of the extensions.

9. A device according to claim 1, comprising a liquid chamber capable of being put under pressure and located remote from the tool structure, and means for ascertaining a variation in the volume of the liquid in the chamber during the radial expansion of the diaphragm.

10. A device according to claim 9, comprising pressure measuring means for measuring the pressure of the liquid during the operation of the device.

* * * * *